US011837378B2

(12) United States Patent
Shimizu et al.

(10) Patent No.: US 11,837,378 B2
(45) Date of Patent: Dec. 5, 2023

(54) COMMUNICATION CABLE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Toru Shimizu, Mie (JP); Kinji Taguchi, Mie (JP); Tatsuya Shimada, Mie (JP); Takaki Endo, Mie (JP); Ryoma Uegaki, Mie (JP); Yuta Yasuyoshi, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/788,409

(22) PCT Filed: Dec. 7, 2020

(86) PCT No.: PCT/JP2020/045479
§ 371 (c)(1),
(2) Date: Jun. 23, 2022

(87) PCT Pub. No.: WO2021/131640
PCT Pub. Date: Jul. 1, 2021

(65) Prior Publication Data

US 2023/0049270 A1 Feb. 16, 2023

(30) Foreign Application Priority Data

Dec. 25, 2019 (JP) ..... 2019-234317

(51) Int. Cl.
*H01B 7/18* (2006.01)
*H01B 11/10* (2006.01)
(Continued)

(52) U.S. Cl.
CPC ..... *H01B 11/1083* (2013.01); *H01B 7/18* (2013.01); *H01B 11/18* (2013.01); *H01F 1/20* (2013.01)

(58) Field of Classification Search
CPC ... H01B 7/02; H01B 7/04; H01B 7/06; H01B 7/08; H01B 7/16; H01B 7/18; H01B 11/1025; H01B 11/06; H01B 11/10
(Continued)

(56) References Cited

U.S. PATENT DOCUMENTS 4,371,742 A * 2/1983 Manly ..... H01B 11/146 174/391
4,383,225 A * 5/1983 Mayer ..... H01B 11/146 333/243
(Continued)

FOREIGN PATENT DOCUMENTS

JP S58-193513 A 11/1983
JP H11-053956 A 2/1999
(Continued)

OTHER PUBLICATIONS

International Search Report dated Jan. 19, 2021 for WO 2021/131640 A1 (4 pages).

*Primary Examiner* — William H. Mayo, III
(74) *Attorney, Agent, or Firm* — Venjuris, P.C.

(57) ABSTRACT

A communication cable includes a coating layer that contains a powdery magnetic material and that can suppress the occurrence of a powdery substance containing the magnetic material when processing the coating layer. The communication cable further includes a conductor, an insulating
(Continued)

coating that covers an outer circumstance of the conductor, and a magnetic sheath layer that covers an outer side of the insulating coating, and the magnetic sheath layer contains the magnetic material and the magnetic material has a particle shape with an average particle diameter of not more than 50 μm and an aspect ratio of not greater than 4.

11 Claims, 2 Drawing Sheets

(51) Int. Cl.
*H01B 11/18* (2006.01)
*H01F 1/20* (2006.01)

(58) Field of Classification Search
USPC ..... 174/236, 102 R, 102 SC, 102 P, 103, 174/105 R, 106 R, 109; 333/12, 184, 333/243; 428/212, 243, 246, 323, 332, 428/338, 339, 457, 458
See application file for complete search history.

(56) References Cited

U.S. PATENT DOCUMENTS 4,816,614 A * 3/1989 Baigrie ..... H01B 11/143 174/109
5,206,459 A 4/1993 Aldissi
5,252,148 A * 10/1993 Shigeta ..... H01F 3/00 420/104
6,136,429 A * 10/2000 Saito ..... H05K 9/0015 428/338
6,534,708 B2 * 3/2003 Ono ..... H01B 11/1083 174/36
6,723,914 B1 * 4/2004 Kamei ..... H05K 9/0088 148/309
7,671,278 B2 * 3/2010 Fong ..... H01B 11/1083 174/106 R
9,734,939 B2 * 8/2017 Nakatani ..... H01B 11/1025
2004/0055772 A1 * 3/2004 Tsutsui ..... H01B 11/1016 174/36
2009/0114440 A1 * 5/2009 Yamamoto ..... H05K 9/0083 264/105
2016/0360654 A1 * 12/2016 Nakatani ..... H01B 11/1025

FOREIGN PATENT DOCUMENTS

JP H11-086641 A 3/1999
JP 2004-311600 A 11/2004
JP 2008-097932 A 4/2008
JP 2016-197509 A 11/2016
JP 2016-201272 A 12/2016
JP 2016-207298 A 12/2016

* cited by examiner

COMMUNICATION CABLE

CROSS REFERENCE TO RELATED APPLICATIONS

This application is a national phase of PCT application No. PCT/JP2020/045479, filed on 7 Dec. 2020, which claims priority from Japanese patent application No. 2019-234317, filed on 25 Dec. 2019, all of which are incorporated herein by reference.

TECHNICAL FIELD

The present disclosure relates to a communication cable.

BACKGROUND

In communication cables used in the field of automobiles and the like, there are cases in which a shield layer is provided on the outer side of a core wire in order to suppress penetration of noise from the outside and emission of noise to the outside. A shield layer that covers the outer circumference of a core wire using a material in which a powdery magnetic material is dispersed in a high-polymer material is an example of such a shield layer.

Patent Document 1 discloses, for example, a magnetic shield cable provided with a magnetic shield layer formed by a layer of magnetic powder being interposed between coating film layers. As one specific configuration of the cable, a form of a cable is disclosed which includes a central conductor, an insulating layer that covers the circumference of the central conductor, an electromagnetic shield layer that covers the circumference of the insulating layer, an internal coating layer that covers the circumference of the electromagnetic shield layer, a magnetic shield layer that covers the circumference of the internal coating layer, and an external coating layer that covers the circumference of the magnetic shield layer, the magnetic shield layer being formed by a layer or magnetic powder that is interposed between coating film layers. The magnetic shield layer is configured as a braided shield layer or a laterally wound shield layer using strands made of copper or a copper alloy. When use of a communication cable in a high frequency band of 1 GHz or more is assumed, as in the above form, there are many cases in which a shield body made of a metal material such as a metal braid is provided, and a shield layer containing a powdery magnetic material is further provided outside thereof.

PRIOR ART DOCUMENT

Patent Document

Patent Document 1: JP 2016-197509 A
Patent Document 2: JP 2016-201272 A
Patent Document 3: JP H11-086641 A
Patent Document 4: JP 2004-311600 A

SUMMARY OF THE INVENTION

Problems to be Solved

In communication cables, there are many cases, in which part of a coating layer of the outer circumferential portion is removed in order to, for example, connect a terminal portion to an outer member such as a terminal. In such cases, if a shield layer formed of a material obtained by mixing a powdery magnetic material with a polymer material is provided as a coating layer, when removing the shield layer, the particles of the magnetic material form a powdery substance (deposits) with the high polymer material, which tends to exfoliate and disperse. If such a kind of deposit is generated and attaches to the constituent members, such as a conductor, of the communication cable, or an external member to be connected, electrical connection and physical connection between the communication cable and the external member may be affected. In particular, when the communication cable includes a shield body formed by a metal braid, and a coating layer containing a magnetic material is provided on the outer circumference thereof, deposits that stem from the coating layer are likely to be held in a state in which they clog the net of the braid structure of the shield body, and are likely to significantly affect the connection between the communication cable and the external member.

In view of the above, an object of the present invention is to provide a communication cable provided with a coating layer that contains a powdery magnetic material and that can suppress occurrence of a powdery substance that contains a magnetic material when processing the coating layer.

Means to Solve the Problem

A communication cable according to the present disclosure is a communication cable including a conductor, an insulating coating that covers an outer circumference of the conductor, and a magnetic sheath layer that covers an outer side of the insulating coating, and the magnetic sheath layer contains a magnetic material, and the magnetic material has a particle shape with an average particle diameter of not more than 50 μm and an aspect ratio of not greater than 4.

Effect of the Invention

The communication cable according to the present disclosure is a communication cable provided with a coating layer that contains a powdery magnetic material and that can suppress occurrence of a powdery substance that contains a magnetic material when processing the coating layer.

DETAILED DESCRIPTION TO EXECUTE THE INVENTION

Figure 1:
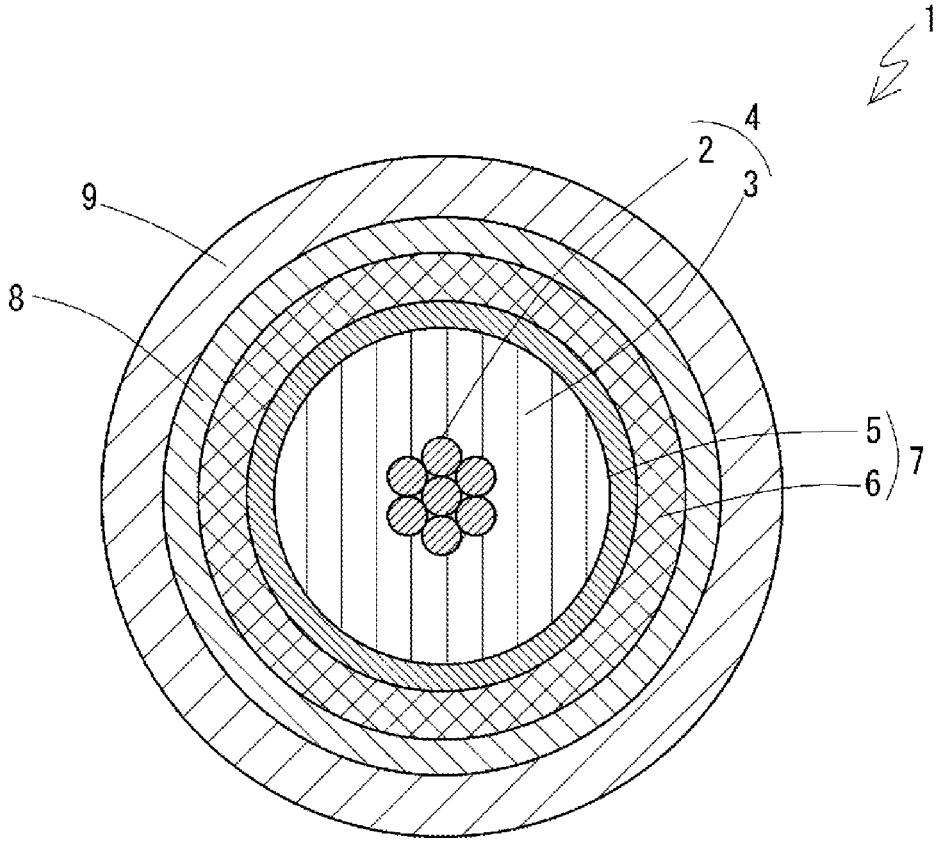
FIG. 1 is a cross-sectional view showing a configuration of a communication cable according to an embodiment of the present disclosure.

Description of the Embodiments of the Disclosure

First, an embodiment of the present disclosure will be described.

A communication cable according to the present disclosure is a communication cable including a conductor, an insulating coating that covers an outer circumference of the conductor, and a magnetic sheath layer that covers an outer side of the insulating coating, and the magnetic sheath layer contains a magnetic material, and the magnetic material has a particle shape with an average particle diameter of not more than 50 μm and an aspect ratio of not greater than 4.

The communication cable includes a magnetic sheath layer that contains a magnetic material on the outer circumference of the core wire in which the insulating coating is provided on the outer circumference of the conductor. By the magnetic material absorbing an electromagnetic wave that causes noise, the magnetic sheath layer exhibits a noise shielding property, and penetration of noise from the outside and emission of noise to the outside can be suppressed. Since the magnetic material contained in the magnetic sheath layer has a particle shape with an average particle diameter of not more than 50 μm and an aspect ratio of not greater than 4, the occurrence of a powdery substance containing a magnetic material can be suppressed when processing the magnetic sheath layer such as removing the magnetic sheath layer at the terminal portion of the communication cable. As a result of this, a situation is unlikely to occur in which the generated powdery substance disperses or exfoliates and attaches to the constituting members of the communication cable such as a conductor, or to an external member, and affects the electrical connection and physical connection between the communication cable and the external member.

It is preferable that the aspect ratio of the magnetic material is not greater than 2. Accordingly, the occurrence of the powdery substance at the time of processing the magnetic sheath layer can be particularly effectively suppressed.

It is preferable that, in the magnetic sheath layer, the magnetic material is dispersed in a polymer material, and at least 350 pts. mass and not more than 750 pts. mass of the magnetic material is contained per 100 pts. mass of the polymer material. Accordingly, occurrence of the powdery substance from the magnetic sheath layer can be effectively suppressed while sufficiently obtaining the noise shielding effect due to the magnetic sheath layer.

It is preferable that a braided layer constituted as a braided body of metal strands between the insulating coating and the magnetic sheath layer. Accordingly, due to the braided layer, the noise shielding property of the communication cable can be further improved. Since the braided layer is present inward of the magnetic sheath layer, when the powdery substance occurs at the time of processing the magnetic sheath layer, the powdery substance clogs the net of the braided body, which makes removing the powdery substance difficult. In view of this, in this communication cable, since the particle diameter and the aspect ratio of the magnetic material contained in the magnetic sheath layer are limited to a predetermined upper limit or less, the occurrence of the powdery substance is suppressed, and thus such a situation is not likely to occur even if a braided layer is provided.

In this case, it is preferable that the communication cable includes a braid exposed portion in which the magnetic sheath layer has been removed and the braided layer is exposed. Such a braid exposed portion can be formed by removing the layer provided outward of the braided layer, including the magnetic sheath layer, at the terminal or the like of the communication cable, and can be used for connection with an external member such as a terminal. When removing the magnetic sheath layer, processing such as cutting in the magnetic sheath layer is needed. Since the possibility that the powdery substance will occur from the magnetic sheath layer, which causes dispersion and exfoliation of the powdery substance at the time of the processing is suppressed, a situation is not likely to occur, in which the powdery substance clogs the net of the braided layer, and the connection with the external member using the braid exposed portion is affected.

In this case, it is preferable that the communication cable further includes a conductor exposed portion in which the magnetic sheath layer, the braided layer, and the insulating coating have all been removed and the conductor is exposed. Accordingly, since occurrence of the powdery substance from the magnetic sheath layer is suppressed, a situation is not likely to occur in which the powdery substance attaches to the surface of the conductor and, when connecting the conductor exposed portion to an external member such as a terminal, affects the connection.

It is preferable that the communication cable further includes an external sheath layer that covers an outer circumference of the magnetic sheath layer and does not contain any magnetic material. Accordingly, due to the external sheath layer, the magnetic sheath layer can be physically protected, making it easy to maintain the noise shielding effect due to the magnetic sheath layer high. Further, due to provision of the external sheath layer, dispersion and exfoliation of the powdery substance from the magnetic sheath layer can be effectively suppressed when processing the magnetic sheath layer.

In this case, it is preferable that the magnetic sheath layer and the external sheath layer respectively contain polymer materials that have compatibility with each other. Accordingly, due to the external sheath layer, the effect of suppressing dispersion and exfoliation of the powdery substance from the magnetic sheath layer can be further improved.

DESCRIPTION OF EMBODIMENTS OF DISCLOSURE

Hereinafter, a communication cable according to an embodiment of the present disclosure will be described in detail.

(Overall Configuration of Communication Cable)

Figure 2:
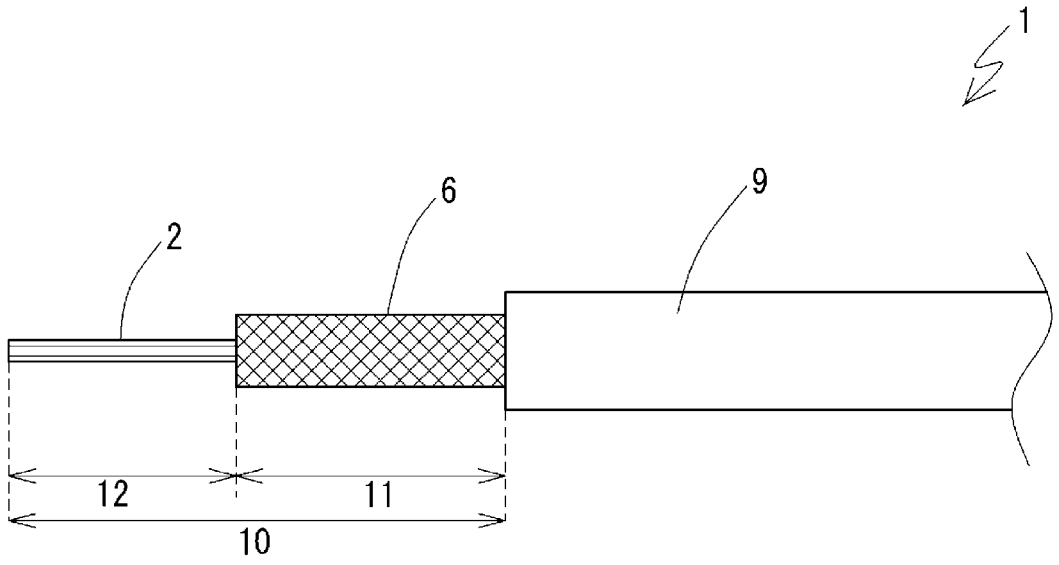
FIG. 2 is a side view showing a terminal portion of the communication cable.

FIG. 1 shows a cross-sectional view of a communication cable 1 according to an embodiment of the present disclosure taken along a line that is vertical to an axial direction. Also, FIG. 2 shows a side view of a configuration of a terminal portion of the communication cable 1.

The communication cable 1 is configured as a coaxial cable. Specifically, the communication cable 1 is provided with a core wire 4 that includes a conductor 2 and an insulating coating 3 that covers the outer circumference of the conductor 2. As a metal shield layer 7, a metal foil 5 and a braided layer 6 formed as a braided body of metal strands are provided on the outer circumference of the core wire 4. The metal foil 5 covers the outer circumference of the core wire 4, and the braided layer 6 covers the outer circumference of the metal foil 5. A magnetic sheath layer 8 that contains a magnetic material is provided on the outer circumference of the metal shield layer 7. Further, an external sheath layer 9 that contains no magnetic material is provided on the outer circumference of the magnetic sheath layer 8. As will be described in detail later, in the communication cable 1 according to the present embodiment, the particle diameter and aspect ratio of the magnetic material contained in the magnetic sheath layer 8 are limited to a predetermined upper limit or less.

It is preferable that an exposed portion 10 that includes a braid exposed portion 11 and a conductor exposed portion 12 is provided at least at one of the two ends of the communication cable 1. At the braid exposed portion 11, the external sheath layer 9 and the magnetic sheath layer 8 have been removed and the braided layer 6 is exposed. The conductor exposed portion 12 is provided on the leading end side of the communication cable 1 and adjacent to the braid exposed portion 11. In the conductor exposed portion 12, the braided layer 6, the metal foil 5 and the insulating coating 3 of the core wire 4 are removed as well as the external sheath layer 9 and the magnetic sheath layer 8, and the conductor 2 forming the core wire 4 is exposed. Due to the exposed portion 10 being formed at the end of the communication cable 1, the communication cable 1 can be electrically connected to an external member such as a terminal. The braided layer 6 that is exposed at the braid exposed portion 11 may be connected to an outer conductor terminal, and the conductor 2 exposed at the conductor exposed portion 12 may be connected to an inner conductor terminal, for example. The braid exposed portion 11 can be formed by, for example, cutting in the entire circumference of the external sheath layer 9 and the magnetic sheath layer 8 at a portion near the end of the communication cable 1, and removing it by drawing out a portion on the leading end side of the communication cable 1 relative to the cut position. Further, by removing a portion on the leading end side of the exposed braided layer 6, and further removing the metal foil 5 and the insulating coating 3 at the same position, the conductor exposed portion 12 can be formed. Accordingly, the exposed portion 10 in which the conductor 2 and the braided layer 6 are adjacent to each other and exposed in a stepped manner is formed at the terminal portion of the communication cable 1.

The communication cable 1 as above, which is configured as a coaxial cable in which the metal shield layer 7 and the magnetic sheath layer 8 are provided on the outer circumference of the core wire 4 can be suitably used for transmission of high frequency signals of 1 GHz or higher. The communication cable according to the present disclosure is however not limited to the above configuration, as long as the magnetic sheath layer 8 is provided covering the outer side of the core wire 4, and any configuration may be adopted, depending on the communication frequency or the use. The magnetic sheath layer 8 may directly cover the outer circumference of the core wire 4, or cover the outer circumference of the core wire 4 via another layer such as the metal shield layer 7.

Although a single insulating wire is used as the core wire 4, for example, in the above aspect, a plurality of insulating wires may also be used. Specifically, a core wire can be configured by a pair of insulating wires being twisted together or wired in parallel so that differential signals are transferred. Also, when the influence of noise is not so significant, only one of the metal foil 5 and the braided layer 6 may be arranged as the metal shield layer 7, or the metal shield layer 7 may be omitted. Also, as the metal shield layer 7, a form other than the metal foil 5 and the braided layer 6 such as a horizontal winding wire may also be used. When the need for the function of protecting the magnetic sheath layer 8 or the like is not so strong, the external sheath layer 9 may also be omitted. Also, although the described layers are respectively in direct contact with the outer circumferences of the constituent inner layers in the above form, the communication cable 1 may also include constituent layers other than the layers described above as appropriate. Hereinafter, the constituent members of the coaxial cable type communication cable 1, which was illustrated above, will be described in detail.

(Core Wire)

The core wire 4 of the communication cable 1 transfers electrical signals and includes a conductor 2 and an insulating coating 3 that covers the outer circumference of the conductor 2. The materials constituting the conductor 2 and the insulating coating 3 are not particularly limited.

Although various metal materials can be used as a material constituting the conductor 2, it is preferable to use a copper alloy in terms of its high conductivity. Although the conductor 2 may also be configured as a single wire, in terms of improving flexibility at bending, it is preferable that the conductor 2 is configured as a twisted wire formed by twisting a plurality of strands (e.g., seven) together. In this case, after being twisted together, the strands may also be compressed and formed into a compressed-and-twisted wire. When the conductor 2 is configured as a twisted wire, the twisted wire may be formed by a single type or two or more types of strands.

The insulating coating 3 preferably contains an insulating polymer material as a main component. Examples of the polymer material include polyolefins such as polyethylene and polypropylene, halogen-based polymers such as polyvinyl chloride, engineering plastics such as polystyrene, polytetrafluoroethylene and polyphenylene sulfide, and various elastomers and rubber. Of these, in terms of improving the communication property, it is preferable to use a polymer material having low molecular polarity. In particular, it is preferable to use a non-polar polymer material such as a polyolefin such as polypropylene. As the polymer material, only a single kind of polymer material may be used, or two or more kinds of polymer materials may be used in combination by mixing, layering or the like. The polymer material may be crosslinked or foamed. The insulating coating 3 may contain an additive such as a flame retardant as appropriate, in addition to the polymer material. However, it is preferable that the insulating coating 3 does not contain an additive made of a magnetic material, such as that contained in the magnetic sheath layer 8.

The diameter of the conductor 2 and the thickness of the insulating coating 3 are not particularly limited. The range of the conductor cross sectional area is, for example, 0.05 $mm^2$ to 1.0 $mm^2$. Also, the range of the thickness of the insulating coating 3 is, for example, 0.1 mm to 0.5 mm (Metal Shield Layer)

The metal shield layer 7 is provided between the core wire 4 and the magnetic sheath layer 8, and has a two-layer structure in which the metal foil 5 and the braided layer 6 are layered.

The metal foil 5 is constituted as a thin film made of a metal material. The kind of metal constituting the metal foil 5 is not particularly limited, and examples thereof include copper, a copper alloy, aluminum, and an aluminum alloy. The metal foil 5 may be constituted by a single kind of metal or the layers of two or more kinds of metal being layered. Also, the metal foil 5 may also be formed by a metal layer being coupled to the base material such as a polymer film by vapor deposition, plating, adhering or the like, as well as an independent thin metal film. In terms of improving the noise shielding property, it is preferable that the metal foil 5 is arranged vertically with respect to the core wire 4.

The braided layer 6 is configured as a braided body that is formed by a plurality of metal strands alternately braided to each other to form a hollow cylindrical shape. Examples of metal strands constituting the braided layer 6 include metal materials such as copper, a copper alloy, aluminum, and an aluminum alloy, or those in which the surface of these metal materials is plated with tin or the like.

The metal shield layer 7 constitutes an outer conductor in the coaxial cable structure, and plays a role in shielding noise penetrating into the core wire 4 and noise emitted from the core wire 4, by electrostatic shielding. As will be described later, in the communication cable 1, the noise shielding effect is exhibited by the magnetic sheath layer 8 as well. However, when the communication cable 1 is used for high frequency communication of 1 GHz or more, the influence of noise is likely to be serious. In view of this, provision of the metal shield layer 7 together with the magnetic sheath layer 8 can effectively suppress the influence of noise. Due to the metal foil 5 and the braided layer 6 being used together as the metal shield layer 7, the noise shielding effect can be improved. The order in which the metal foil 5 and the braided layer 6 are layered is not particularly limited, but it is preferable to arrange the metal foil 5 on the inside and the braided layer 6 on the outside, because of the reason such as reducing a signal loss.

(Magnetic Sheath Layer)

The magnetic sheath layer 8 covers the outer circumference of the core wire 4. In the present embodiment, the magnetic sheath layer 8 covers the outer circumference of the core wire 4 via the metal shield layer 7.

The magnetic sheath layer 8 contains a particulate magnetic material. The magnetic material contained in the magnetic sheath layer 8 is preferably a ferromagnetic material, and more preferably, a metal or a metal compound having a soft magnetic property. Due to a magnetic material, in particular, a soft magnetic material being contained in the magnetic sheath layer 8, an excellent noise shielding effect of the communication cable 1 can be obtained. In other words, it is possible to suppress a phenomenon in which noise from the outside of the communication cable 1 penetrates into the communication cable 1 and affects the signals transferred in the core wire 4, and a phenomenon in which noise caused by the signals transferred in the core wire 4 is emitted to the outside of the communication cable 1. This is because, due to a magnetic loss in the magnetic material contained in the magnetic sheath layer 8, the high frequency electromagnetic wave that may cause noise is absorbed and attenuated.

Examples of soft magnetic materials that exhibit a high noise shielding property in the high frequency region of 1 GHz or higher include iron (pure iron or iron containing a small amount of carbon), silicon steel, Fe—Si—Al alloy (sendust), magnetic stainless steel such as Fe—Cr—Al—Si alloy and Fe—Cr—Si alloy, Fe—Ni based alloy (permalloy), and ferrite. Among these, in terms of being particularly excellent in the noise shielding property, it is particularly preferable to use Fe—Si—Al alloy or ferrite. As ferrite, Ni—Zn based ferrite, Mn—Zn based ferrite, or the like can be suitably used. Only a single kind of the magnetic material or two or more kinds of the magnetic materials that are blended by mixing or the like may be used.

In the magnetic sheath layer 8, the magnetic material has a particle shape and is dispersed in the matrix material. It is preferable to use a non-magnetic dielectric as the matrix material. In terms of ensuring flexibility and the like, it is more preferable to use a polymer material such as a resin material as the matrix material. Similarly to the polymer material constituting the insulating coating 3 of the core wire 4, examples of the polymer material include polyolefins such as polyethylene and polypropylene, halogen-based polymers such as polyvinyl chloride, engineering plastics such as polystyrene, polytetrafluoroethylene, polyphenylene sulfide, various elastomers, and rubbers. Among these, it is preferable to use polyolefin such as polypropylene or polyvinyl chloride in terms of excellent insulation and heat resistance, for example. A single kind of polymer material or two or more kinds of polymer materials blended by mixing or layering may be used. The polymer material may be crosslinked or foamed. The polymer material constituting the magnetic sheath layer 8 may be the same as or different from the polymer material constituting the insulating coating 3 of the core wire 4.

The magnetic sheath layer 8 may contain an additive such as a flame retardant as appropriate in addition to the polymer material. However, it is preferable that the magnetic sheath layer 8 does not contain any magnetic additive with a particle diameter and aspect ratio that are larger than the upper limit, which will be described later, except for unavoidable impurities. It is also preferable that the magnetic sheath layer 8 does not contain any non-magnetic additive with a particle diameter and aspect ratio that are larger than the upper limit, which will be described later with respect to the magnetic materials, except for unavoidable impurities.

The average particle diameter (D50 value of the equivalent circle diameter in electron microscope observation) particles of the magnetic material contained in the magnetic sheath layer 8 is not more than 50 μm. If the particle diameter of the magnetic material is too large, a situation is likely to occur, in which the tissue of the compound material in which the magnetic material is dispersed in the matrix material becomes fragile, and the magnetic material and the matrix material form a powdery substance (deposits), and exfoliate from the magnetic sheath layer 8. However, due to the average particle diameter of the magnetic material being limited to not more than 50 μm, the affinity between the magnetic material and the matrix material is improved and the bond between the magnetic material and the matrix material is strengthened. Accordingly, a situation is not likely to occur, in which the magnetic material and the matrix material form deposits when the magnetic sheath layer 8 is subjected to processing such as cutting, and the formed deposits come off from the magnetic sheath layer 8, and disperse or exfoliate. The magnetic material having an average particle diameter of not more than 50 μm exhibits an excellent effect in shielding noise as well. In terms of obtaining a higher effect of noise shielding and suppressing occurrence of deposits, the particle diameter of the magnetic material is preferably 25 μm or less, more preferably 20 μm or less, and even more preferably 15 μm or less. Although it is preferable that the magnetic material is dispersed in the matrix material without forming secondary particles by aggregation or the like, if secondary particles are formed, it is preferable that the secondary particle diameter is not greater than the above-described upper limit, just like the primary particle diameter.

The particle diameter of the magnetic material does not have a lower limit in particular. However, in terms of avoiding the saturation of the effect of suppressing deposits due to fine particles, or in terms of ensuring handleability of the magnetic material, the average particle diameter is preferably set to at least 0.5 μm. More preferably, the average particle diameter is set to at least 1 μm, or at least 5 μm.

Further, the aspect ratio of the particles of the magnetic material contained in the magnetic sheath layer 8 is not greater than 4. If the aspect ratio of the particles of magnetic material increases, the specific surface area of the magnetic material also increases, and the contact area of the magnetic material with the matrix material becomes large. Accordingly, when processing the magnetic sheath layer 8, the matrix material containing the magnetic material forms deposits, and such deposits are likely to disperse and exfoliate. However, if the aspect ratio of the magnetic material is limited to not greater than 4 so that the specific surface area is set small, deposits are not likely to occur at the time of processing. In terms of further improving the effect of suppressing deposits, the aspect ratio of the magnetic material is preferably set to not greater than 3, and more preferably, not greater than 2.

The lower limit of the aspect ratio of the particles of the magnetic material is not particularly limited in terms of the occurrence of deposits. However, since the larger the aspect ratio, the higher the noise shielding effect due to the magnetic sheath layer 8, the aspect ratio is preferably at least 1.5. As described above, in terms of particularly improving the effect of suppressing deposits when processing the magnetic sheath layer 8, the aspect ratio of the magnetic material is preferably set to not greater than 2, but if the improvement of the noise shielding effect is prioritized, the aspect ratio may be set to greater than 2. That is, the aspect ratio of the magnetic material may be selected in the range of not greater than 4, depending on the level required to suppress the occurrence of the deposits and shield noise.

As described above, due to the magnetic material with the particles having the average particle diameter of not more than 50 μm and the aspect ratio of not greater than 4 being used as the material contained in the magnetic sheath layer 8, it is possible to suppress deposits that disperse and exfoliate when the magnetic sheath layer 8 is subjected to mechanical processing such as cutting. If deposits containing the magnetic material occur from the magnetic sheath layer 8, disperse, and exfoliate, there is a possibility that those deposits attach to other constituent members of the communication cable 1 or external members connected to the communication cable 1, such as a terminal, and affects electrical connection and physical connection between the communication cable 1 and the external member. Even the deposits attached to any portion of the communication cable 1 can be visually confirmed, if the amount of the occurrence of deposits is suppressed to an extent that exfoliation of the deposits from the communication cable 1 is not visible, the influence of the deposits on the connection between the communication cable 1 and the external member can be ignored. However, if a large amount of deposits occurs and the amount of the deposits attached to the communication cable 1 reaches an extent that the deposits cannot stay on the surface of the communication cable 1 and drop off from the communication cable 1, the deposits may have a significant influence on the connection between the communication cable 1 and the external member.

If deposits are present at a location where an electrical connection is formed, such as between the conductor 2 and the inner conductor terminal or between the braided layer 6 and the outer conductor terminal, the deposits may cause a rise in the electrical resistance, and the connection may be loosened. Also, due to the deposits being present between members that are in contact with each other, the physical connection may become unstable. If the occurrence of deposits becomes more frequent, the constituent material which forms the deposits is lost from the magnetic sheath layer 8, which may lead to an adverse effect such as a decrease in workability at connecting the magnetic sheath layer 8 to the external member. If the occurrence of deposits from the magnetic sheath layer 8, and dispersion and exfoliation of the deposits are suppressed, the adverse effects due to deposits as described above can be prevented, and suitable electrical connection and physical connection, as well as workability at the time of connecting the communication cable 1 to the external member can be ensured.

In particular, when the communication cable 1 is configured such that the braided layer 6 is provided inward of the magnetic sheath layer 8 as described above, if deposits stem from the magnetic sheath layer 8, the deposits attach to the braided layer 6 in a state of clogging into the net thereof, and are likely to be held by the braided layer 6 in this state. However, due to the restriction of the particle diameter and the aspect ratio of the magnetic material in the magnetic sheath layer 8, the occurrence of deposits is suppressed, thus making it possible to effectively suppress the attachment of the deposits to the braided layer 6. As described above, as a result of performing processing for removing the magnetic sheath layer 8 at the terminal portion of the communication cable 1, the braid exposed portion 11 is formed, and the exposed braided layer 6 is connected to the terminal or the like. When performing processing for forming the braid exposed portion 11, the deposits that occur from the magnetic sheath layer 8 are not likely to attach to the exposed braided layer 6, thus making it possible to suitably connect the braided layer 6 and the terminal or the like. Similarly, regarding the conductor exposed portion 12, since attachment of the deposits is suppressed, suitable connection with the terminal or the like can be formed.

In the magnetic sheath layer 8, the content of the magnetic material is not particularly limited, but in terms of improving the noise shielding effect, the content may be set to at least 350 pts. mass per 100 pts. mass of the matrix material. On the other hand, in terms of effectively suppressing deposits from the magnetic sheath layer 8, the content may be set to not greater than 750 pts. mass.

Also, in terms of improving the noise shielding effect, the thickness of the magnetic sheath layer 8 may be set to at least 0.2 mm. On the other hand, in terms of preventing an excessive increase in the diameter of the communication cable 1, the thickness may be 0.5 mm at most. The magnetic sheath layer 8 may also be provided by layering a plurality of types of layers having different types and amounts of the magnetic material contained therein.

The magnitude of the noise shielding effect due to the magnetic sheath layer 8 can be adjusted using parameters such as the type, the particle diameter, the aspect ratio, the density and the like of the magnetic material to be used. The noise shielding effect can be evaluated in the form of the noise amount when a signal is input to the communication cable 1, and as shown in the examples (described later), the parameters relating to the magnetic material to be used may be selected such that the noise amount is −100 dB or less, and further, −110 dB or less.

(External Sheath Layer)

An external sheath layer 9 is a layer provided covering the outer circumference of the magnetic sheath layer 8, and exposed on the outer circumference of the entirety of the communication cable 1. The external sheath layer 9 does not contain any magnetic material except for unavoidable impurities.

The external sheath layer 9 preferably contains a polymer material as its main component. Similarly to the matrix material constituting the magnetic sheath layer 8, specific examples of the polymer material can include polyolefins such as polyethylene and polypropylene, halogen-based polymers such as polyvinyl chloride, engineering plastics such as polystyrene, polytetrafluoroethylene, polyphenylene sulfide, various elastomers, and rubbers. Among these, in terms of excellent insulation and heat resistance, it is preferable to use a polyolefin such as polypropylene or polyvinyl chloride. A single kind of polymer material or two or more kinds of polymer materials blended by mixing, layering or the like may be used. The polymer material may be cross-linked or foamed. The magnetic sheath layer 8 may contain an additive such as a flame retardant as appropriate in addition to the polymer material.

The polymer material constituting the external sheath layer 9 may be the same as or different from the matrix material constituting the magnetic sheath layer 8. It is preferable that the polymer material constituting the external sheath layer 9 and the matrix material constituting the magnetic sheath layer 8 are compatible with each other. More preferably, the two materials are constituted by the same type of polymer material. Even more preferably, the external sheath layer 9 is constituted by the same material as the magnetic sheath layer 8 other than that the material does not contain the magnetic material. In the case where the magnetic sheath layer 8 is formed by a material in which the magnetic material is dispersed in the polypropylene, for example, the external sheath layer 9 may be constituted by polypropylene containing no magnetic material.

The external sheath layer 9 has a function of physically protecting the magnetic sheath layer 8 and the constituent members located inward of the magnetic sheath layer 8 from contact with external substances and the like. Further, in the magnetic sheath layer 8, there are some cases in which, due to the magnetic material being contained, the hardness improves and damages such as cracks and breaks are likely to be generated. In such cases, due to the magnetic sheath layer 8 being covered by the external sheath layer 9, even if damage such as cracks and breaks are generated in the magnetic sheath layer 8, a case can be suppressed in which the damage advances and forms a larger gap. Accordingly, a situation is not likely to occur in which a gap is formed in a surface of the magnetic sheath layer 8 due to the damage getting worse, and by the electromagnetic wave leaking via the gap, the noise shielding property of the magnetic sheath layer 8 decreases. Further, due to the magnetic sheath layer 8 being covered by the external sheath layer 9, when performing processing on the magnetic sheath layer 8, it is possible to effectively suppress cases, in which deposits stem from the magnetic sheath layer 8 and disperse to the outside. If the polymer material constituting the external sheath layer 9 is compatible with, and the same as, the matrix material of the magnetic sheath layer 8, contact between the external sheath layer 9 and the magnetic sheath layer 8 becomes closer, and the effect of suppressing the occurrence and dispersion of the deposits from the magnetic sheath layer 8 due to the external sheath layer 9 is particularly improved.

The thickness of the external sheath layer 9 is not particularly limited, but in terms of particularly improving the protection performance with respect to the magnetic sheath layer 8 and the effect of suppressing dispersion of deposits, the thickness may be at least 0.1 mm. Also, the thickness of the external sheath layer 9 may be the thickness of the magnetic sheath layer 8 or more. On the other hand, in terms of preventing an excessive increase in the diameter of the communication cable 1, the thickness of the external sheath layer 9 may be 0.5 mm or less. Also, the thickness of the external sheath layer 9 may be twice the thickness of the magnetic sheath layer 8 or less.

Examples

Hereinafter, examples will be described. Note that the present invention is not limited to these examples. In the present examples, evaluations of the properties are performed at room temperature and in the atmosphere.

[Preparation of Samples]

A core wire was obtained by forming an insulating coating on the outer circumference of a conductor that is constituted as a twisted wire made of a copper alloy, using formed crosslinked polypropylene. The conductor cross sectional area was set to 0.22 $mm^2$, and the thickness of the insulating coating was set to 0.195 mm. The outer diameter of the core wire was 0.85 mm.

As a metal foil, a copper foil was arranged vertically on the outer circumference of the core wire. Further, a braided layer was formed on the outer circumference of the copper foil. The braided layer was formed as a single braid formed by a tin-plated annealed copper wire (TA wire).

A magnetic sheath layer was formed on the outer circumference of the braided layer. As the magnetic sheath layer, a material obtained by mixing powder of the magnetic material with polypropylene serving as the matrix material was subjected to extrusion molding with a thickness of 0.25 mm Regarding the magnetic material, as shown in Table 1, the type, the average particle diameter, the aspect ratio, and the content were selected for each of the samples A1 to A6 and B1 to B3. For all the samples, the outer diameter in the state where the magnetic sheath layer was formed was 2.7 mm.

Further, for each of the samples, polypropylene that contains no magnetic material was formed by extrusion molding on the outer circumference of the magnetic sheath layer to form an external sheath layer, and thus a communication cable was completed. The thickness of the external sheath layer was set to 0.25 mm. The entire diameter of the communication cable was 3.2 mm

[Evaluation]

(1) Peeling Property

Peeling properties of the prepared communication cables were evaluated in order to estimate the extent of occurrence of the deposits at the time of processing the magnetic sheath layer. Specifically, first, the external sheath layer and the magnetic sheath layer were removed from the outer circumference of the braided layer to form the braid exposed portion at the terminal portion of each of the communication cables. Further, at a portion on the terminal side of the braid exposed portion, the braided layer, the copper foil, and the insulating coating were removed from the outer circumference of the conductor to form the conductor exposed portion. Through the above processing, the exposed portion in which the braided layer and the conductor were exposed in a stepped manner was formed at the end portion of the communication cable as shown in FIG. 2.

As described above, after forming the exposed portion at the terminal portion of the communication cable, the exposed portion and the vicinity thereof was visually observed. If deposits that stem from the magnetic sheath layer that were attached to the communication cable or that had dropped from the communication cable could not be confirmed, then the peeling property was evaluated as very high (+A). If deposits attached to the braided layer or the conductor of the exposed portion were observed, but the amount of the generated deposits was small and no deposit that had dropped from the communication cable was confirmed, the peeling property was evaluated as high (A). If the amount of deposits attached to the braided layer or the conductor reached an extent that the deposits dropped off instead of staying on the communication cable, the peeling property was evaluated as low (B).

(2) Noise Shielding Property

As the communication performance of the communication cable, the amount of noise was evaluated according to IEC 62153-4. At the measurement, the amount of noise when a signal with the frequency of 1.5 GHz is input was measured using a network analyzer, for each of the communication cables according to the samples prepared as above.

[Results]

Table 1 shows configurations of the magnetic material contained in the magnetic sheath layer and evaluation results of peeling property and the amount of noise, for each of the samples A1 to A6 and B1 to B3. In the table, the average particle diameter of the magnetic material indicates the D50 value of the equivalent circle diameter in electron microscope observation, and the content of the magnetic material is indicated by pts. mass per 100 pts. mass of the matrix material (polypropylene).

Further, comparing the samples A2 to A5 with each other, compared with the samples A4 and A5 having an aspect ratio of the magnetic material of at least 3, the samples A2 and A3 having an aspect ratio of 2 exhibit a higher peeling property (A+), and the occurrence of deposits from the magnetic sheath layer is highly suppressed. It can be seen from this that, in the range in which the aspect ratio is not greater than 4, decreasing the aspect ratio makes it possible to particularly effectively suppress the occurrence of the deposits from the magnetic sheath layer. Although the particle diameters of the magnetic materials of the samples A1 to A3 are different from each other, all of the samples exhibit a particularly high peeling property (A+).

TABLE 1

| Sample No. | | A1 | A2 | A3 | A4 | A5 |
|---|---|---|---|---|---|---|
| Magnetic material in magnetic sheath layer | Type | Ni-Zn ferrite | Ni-Zn ferrite | Ni-Zn ferrite | Ni-Zn ferrite | Ni-Zn ferrite |
| | Average particle diameter | 0.8 μm | 12 μm | 20 μm | 12 μm | 20 μm |
| | Aspect ratio | 2 | 2 | 2 | 3 | 4 |
| | Content | 700 pts | 700 pts | 700 pts | 700 pts | 700 pts |
| Peeling property | | A+ | A+ | A+ | A | A |
| Noise amount | | −110 dB | −112 dB | −115 dB | −115 dB | −115 dB |

| Sample No. | | A6 | B1 | B2 | B3 |
|---|---|---|---|---|---|
| Magnetic material in magnetic sheath layer | Type | Fe-Si-Al alloy | Mn-Zn ferrite | Fe-Si-Al alloy | Fe-Si-Al alloy |
| | Average particle diameter | 5 μm | 60 μm | 25 μm | 45 μm |
| | Aspect ratio | 2 | 2 | 5 | 5 |
| | Content | 700 pts | 700 pts | 330 pts | 330 pts |
| Peeling property | | A+ | B | B | B |
| Noise amount | | −106 dB | −109 dB | −107 dB | −107 dB |

According to Table 1, the samples A1 to A6, in which the magnetic material in the magnetic sheath layer have a particle shape with an average particle diameter of not more than 50 μm and an aspect ratio of not greater than 4, exhibit a high peeling property (A or A+) in both cases where the magnetic material is made of ferrite and Fe—Si—Al alloy. That is, the occurrence of the deposits from the magnetic sheath layer is suppressed when processing of the terminal. Also, the measurement value of the noise amount is −105 dB or less, and a high noise shielding effect is obtained due to the magnetic sheath layer.

Unlike these samples A1 to A6, the sample B1 having an average particle diameter of the magnetic material that exceeds 50 μm and the samples B2 and B3 having an aspect ratio that exceeds 4 exhibit a low peeling property (B). That is, a large amount of deposits stems from the magnetic sheath layer to the extent that the deposits drops off from the communication cable. Particularly, in the samples B2 and B3 having a larger aspect ratio than the samples A1 to A6, although the content of the magnetic material is reduced to half or less, a large amount of deposits occurred when processing the terminal. In this manner, from the comparison between the peeling properties of the samples A1 to A6 and the samples B1 to B3, it is confirmed that, using the particles having the average particle diameter of not more than 50 μm and the aspect ratio of not greater than 4 as the magnetic material contained in the magnetic sheath layer, the occurrence of deposits is suppressed when processing the magnetic sheath layer.

As described above, although embodiments of the present disclosure have been specifically described, the present invention is not limited to the above embodiments by any means, and various modifications can be made within the spirit of the present invention.

LIST OF REFERENCE NUMERALS

1 Communication cable
2 Conductor
3 Insulating coating
4 Core wire
5 Metal foil
6 Braided layer
7 Metal shield layer
8 Magnetic sheath layer
9 External sheath layer
10 Exposed portion
11 Braid exposed portion
12 Conductor exposed portion

What is claimed is:

1. A communication cable comprising:

a conductor;

an insulating coating that covers an outer circumference of the conductor; and a magnetic sheath layer that covers an outer side of the insulating coating, wherein the magnetic sheath layer contains a magnetic material, and the magnetic material has a particle shape with an average particle diameter of not more than 50 μm, and has an aspect ratio of at least 1.5 and not greater than 4, the average particle diameter representing a D50 value of an equivalent circle diameter in electron microscope observation, and the magnetic sheath layer does not contain a magnetic additive with an aspect ratio that is larger than 4, except for unavoidable impurities.

2. The communication cable according to claim 1, wherein the aspect ratio of the magnetic material is not greater than 2, and the magnetic sheath layer does not contain a magnetic additive with an aspect ratio that is larger than 2, except for unavoidable impurities.

3. The communication cable according to claim 1, wherein, in the magnetic sheath layer, the magnetic material is dispersed in a polymer material, and at least 350 pts. mass and not more than 750 pts. mass of the magnetic material is contained per 100 pts. mass of the polymer material.

4. The communication cable according to claim 1, further comprising:

a braided layer constituted as a braided body of metal strands between the insulating coating and the magnetic sheath layer.

5. The communication cable according to claim 4, comprising:

a braid exposed portion in which the magnetic sheath layer has been removed and the braided layer is exposed.

6. The communication cable according to claim 5, further comprising:

a conductor exposed portion in which the magnetic sheath layer, the braided layer, and the insulating coating have all been removed and the conductor is exposed.

7. The communication cable according to claim 1, further comprising:

an external sheath layer that covers an outer circumference of the magnetic sheath layer and does not contain any magnetic material.

8. The communication cable according to claim 7, wherein the magnetic sheath layer and the external sheath layer respectively contain polymer materials that have compatibility with each other.

9. The communication cable according to claim 7, wherein the external sheath layer has a thickness ranging from 0.1 mm to 0.5 mm.

10. The communication cable according to claim 1, wherein the average particle diameter of the magnetic material is not greater than 15 μm.

11. The communication cable according to claim 1, wherein the magnetic sheath layer has a thickness ranging from 0.2 mm to 0.5 mm.

* * * * *